US005934776A

United States Patent [19]

Motta

[11] Patent Number: 5,934,776

[45] Date of Patent: Aug. 10, 1999

[54] DEVICE FOR SLOWING THE DOWNWARDS TRAVEL OF A VERTICALLY SLIDING WARDROBE DOOR

[75] Inventor: Giuseppe Motta, Bellagio, Italy

[73] Assignee: Unifor S.p.A, Turate, Italy

[21] Appl. No.: 09/027,628

[22] Filed: Feb. 23, 1998

[30] Foreign Application Priority Data

Feb. 28, 1997 [IT] Italy ..... MI9700147 U

[51] Int. Cl.[6] ..... E06B 9/15

[52] U.S. Cl. ..... 312/297; 312/319.1; 160/189; 109/15; 109/17; 188/82.7; 188/82.77

[58] Field of Search ..... 312/297, 272, 312/319.1, 319.5, 110, 350; 160/188, 189, 190, 191, 192; 109/11, 14, 15, 17, 18; 188/80, 82.7, 82.77

[56] References Cited

U.S. PATENT DOCUMENTS

| | | | |
|---|---|---|---|
| 2,142,562 | 1/1939 | Greegor et al. | 312/297 X |
| 2,909,718 | 10/1959 | Lawick | 312/297 X |
| 3,240,484 | 3/1966 | Klamp | 160/189 |
| 3,637,004 | 1/1972 | Wardlaw et al. | 160/189 X |
| 3,695,332 | 10/1972 | Bahnsen | 160/188 |
| 5,159,967 | 11/1992 | Ashley et al. | 160/189 X |

FOREIGN PATENT DOCUMENTS

| | | | |
|---|---|---|---|
| 659411 | 6/1929 | France | 312/297 |
| 458981 | 8/1926 | Germany | 312/297 |

*Primary Examiner*—Peter M. Cuomo
*Assistant Examiner*—James O. Hansen
*Attorney, Agent, or Firm*—Wenderoth, Lind & Ponack, L.L.P.

[57] ABSTRACT

A device for slowing a downward movement of a sliding door of a wardrobe includes a free-wheel consisting of a driving portion and a driven portion. The driven portion is coaxially aligned with the driving portion and is provided with an external toothing. The device also includes a driving rope running through the free-wheel driving portion which is fastened at one end to the sliding door and at another end, by interposition of a tension spring, to a base of the wardrobe. Additionally a spring is arranged between the free-wheel driving and driven portions and is used to engage the two free-wheel portions during the downward movement of the sliding door and to disengage the two during upward movement of the sliding door. A centrifugal brake is coupled to a spindle which is provided with an external toothing cooperating with the external toothing of the free-wheel driven portion. The centrifugal brake is used to generate a resisting torque capable of braking the free-wheel driving and driven portions and slowing the downward movement of the sliding door.

12 Claims, 3 Drawing Sheets

DEVICE FOR SLOWING THE DOWNWARDS TRAVEL OF A VERTICALLY SLIDING WARDROBE DOOR

BACKGROUND OF THE INVENTION

The present invention generally relates to wardrobes, for example closets, cabinets or the like, of a common type which have a vertically sliding door for providing access to the wardrobe. More particularly, the invention relates to a device for slowing the downward travel of the vertically sliding wardrobe door.

As known in the art, in the above mentioned wardrobes laterally hinged doors have been replaced with sliding doors which are capable of sliding vertically along lateral guides arranged on two sides of the wardrobe. One feature of this type of wardrobe is that the doors slide with a very little amount of friction.

In comparison with the traditional wardrobes with hinged doors, the wardrobes with sliding doors have an advantage in the sense that its door, when opened, does not act as an obstacle or occupy an obtrusive amount of space. Therefore, they are particularly well suited for furnishing the interiors of houses and offices whenever it is desirable to save space and to prevent the open door of the wardrobe from obstructing a passage and interfering with the user, while maintaining the same capacity conditions.

However, wardrobes provided with a sliding door also have some drawbacks. A particularly serious disadvantage is related to an excessive speed that the sliding door can attain during its free downward travel due to the small amount of friction generated by the guides. For this reason, often times the downward travel of the sliding door comes to a stop with the door violently impacting against the base of the wardrobe. Of course, this should be avoided because in the long run the impacting could be detrimental to the integrity of the sliding door. On the other hand, it would be troublesome to require the user to manually slow the downward travel of the sliding door by hand each time the door is closed.

SUMMARY OF THE INVENTION

The present invention is intended to address the above mentioned disadvantage by providing a device which is capable of automatically slowing the downward movement of the sliding door of a wardrobe.

More particularly, the device for slowing the downward movement of the sliding door of a wardrobe includes: a free-wheel, a driving rope, a spring and a centrifugal brake. The free-wheel consists of a driving portion and a driven portion. The driven portion is coaxially aligned with the driving portion and is provided with an external toothing. The driving rope runs through the free-wheel driving portion and is fastened at one end to the sliding door and at the other end, by interposition of a tension spring, to a base of the wardrobe. The spring is arranged between the free-wheel driving portion and the driven portion and is intended to engage the two free-wheel portions during the downward movement of the sliding door. The spring is also intended to disengage during an upward movement of the sliding door. The centrifugal brake is coupled to a spindle which is provided with an external toothing cooperating with the external toothing of the free-wheel driven portion. The centrifugal brake generates a resisting torque capable of braking the free-wheel driving and driven portions and slows the downward movement of the sliding door.

According to a feature of the present invention, the free-wheel driving portion is a pulley provided with a grooved rim for receiving the driving rope.

According to another feature of the present invention, the free-wheel driven portion is a gear wheel.

According to yet another feature of the present invention, the spring is arranged between the free-wheel driving and driven portions and is a helical spring wound around the free-wheel portions.

According to still another feature of the present invention, a pair of pulleys is provided for tensioning the driving rope and ensuring that the contact angle of the driving rope with free-wheel driving portion permits the torque to be transmitted without the driving rope slipping.

BRIEF DESCRIPTION OF THE DRAWINGS

The present invention will be fully described with reference to the accompanying drawings, wherein.

DESCRIPTION OF THE PREFERRED EMBODIMENT

Figure 1:
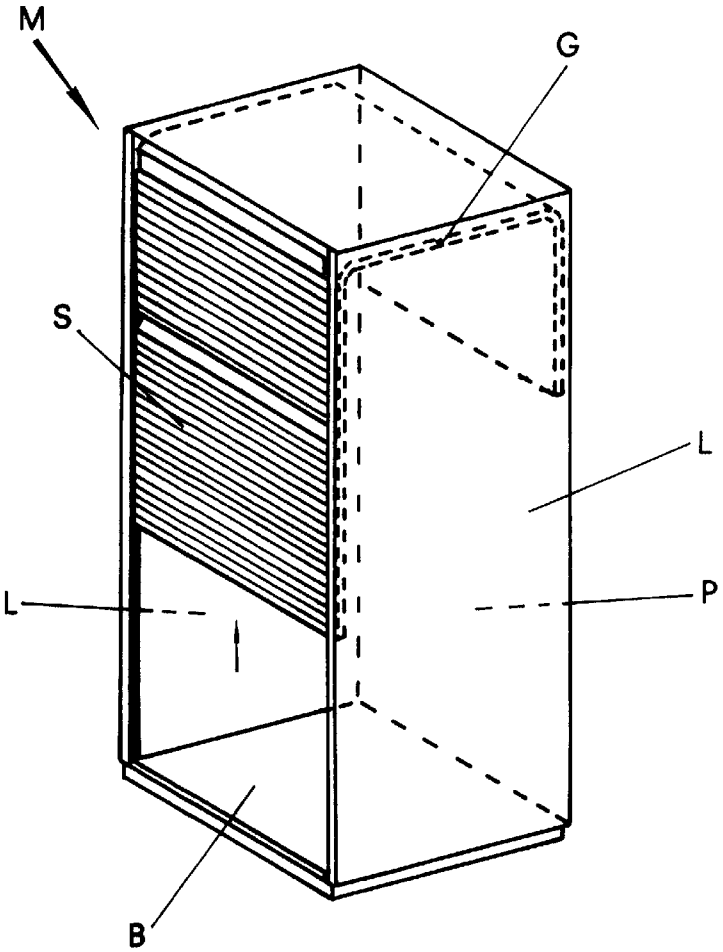
FIG. 1 is a perspective view of a wardrobe with a sliding door to which a device according to the invention is intended to be applied.

In FIG. 1, a typical wardrobe for which the device of the invention is designed is designated by the reference letter M. The wardrobe M is provided with a sliding door S which is capable of moving vertically along a pair of guides G represented by dashed lines. The guides G are arranged inside the wardrobe M, on side panels L of the wardrobe M and generate a very small amount of friction when the door is opened or closed.

Figure 2:
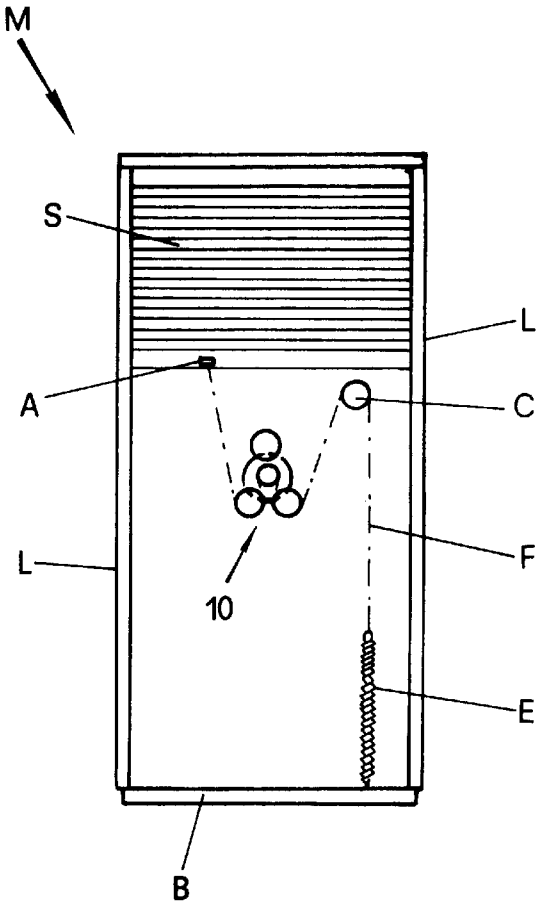
FIG. 2 is a rear view of the wardrobe illustrated in FIG. 1 wherein the device of the invention is diagrammatically shown applied to a rear panel thereof.

FIG. 2 diagrammatically illustrates the device of the present invention, generally indicated by 10 and which is arranged inside the wardrobe M on a rear wall P thereof. A driving rope F is fastened at one end to an attachment A provided on the sliding door S and at another end to a tension spring E connected to a base B of the wardrobe M. This rope F is, in turn, used to apply tension to the driving rope F. The driving rope F is passed through the device 10 of the invention and around a pulley C which is supported by a bracket (not shown) attached to the rear wall P of the wardrobe M.

Figure 3:
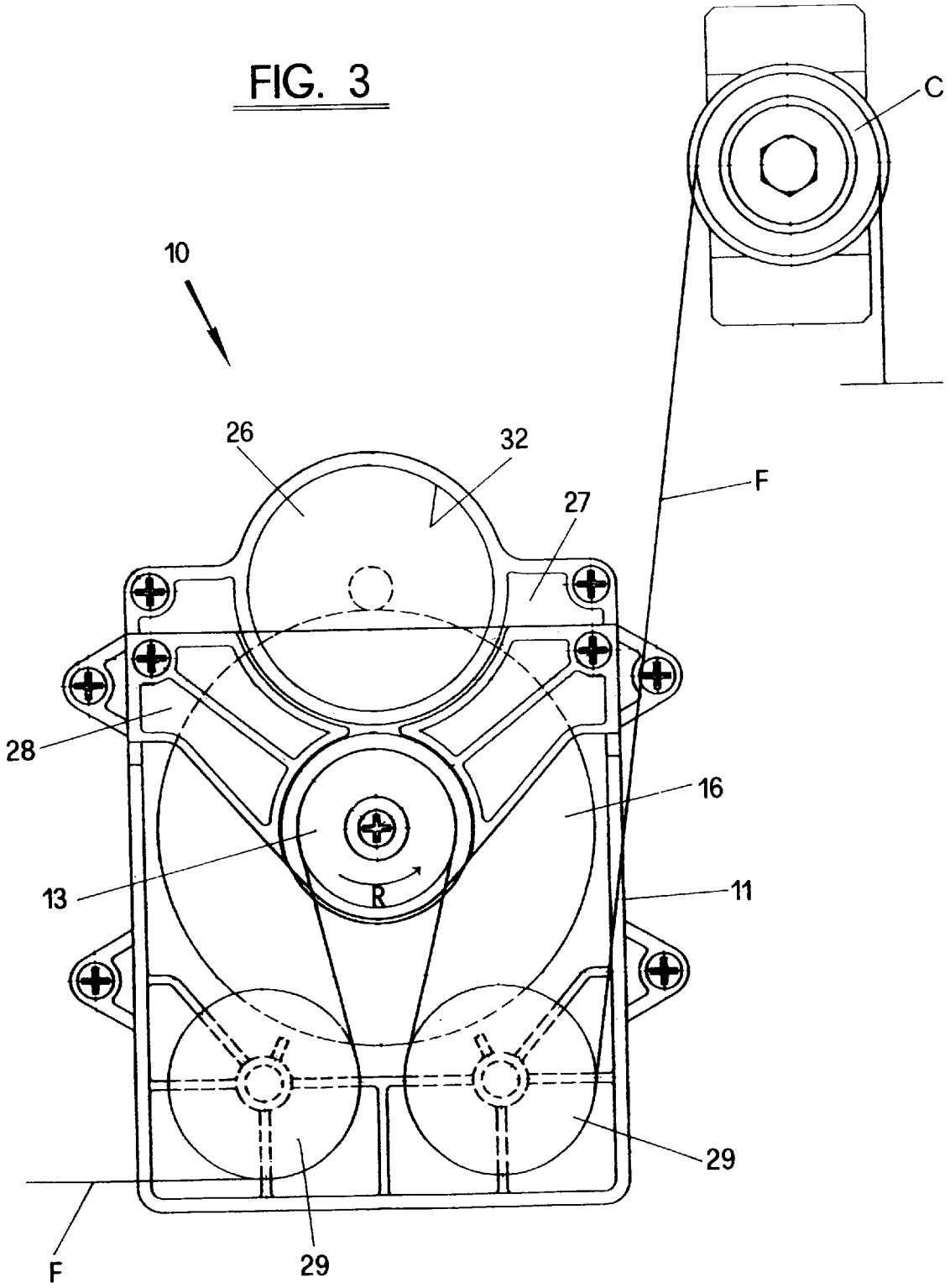
FIG. 3 is a plan top view of the device according to the invention.
Figure 4:
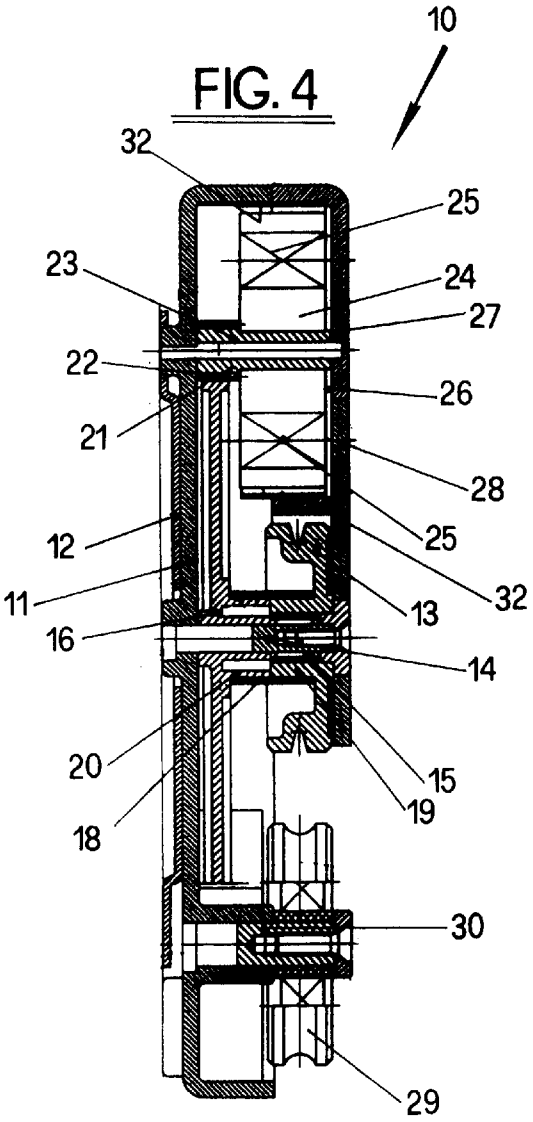
FIG. 4 is a sectional view of the device according to the invention.

Referring now to FIGS. 3 and 4, the device 10 of the invention is shown in greater detail. The device 10 is provided with a mounting base 11 which is connected to the rear wall P of the wardrobe M by an attachment plate 12.

Figure 5:
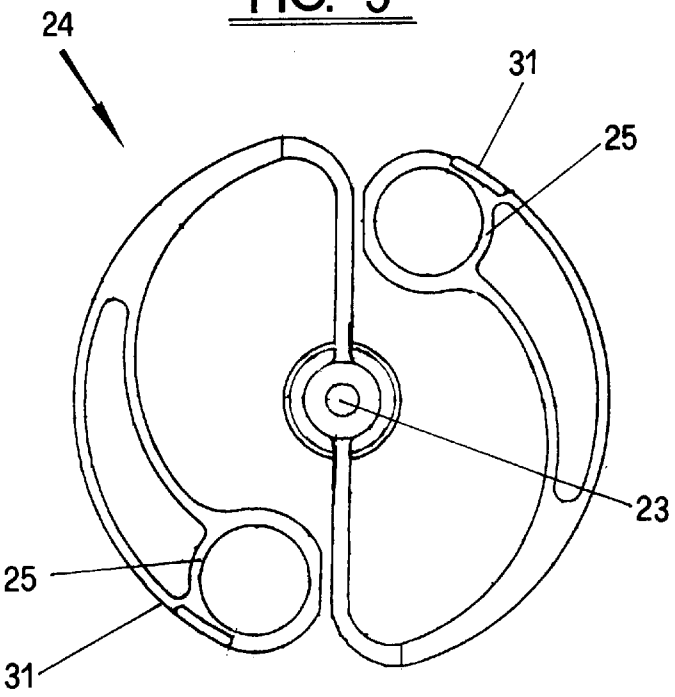
FIG. 5 is a plan top view of an expanding brake of the device of the invention.

The mounting base 11 supports a free-wheel consisting of a pulley 13 which is rotatable around a pivot 14 via a roller bearing 15. The free-wheel also consists of an idle gear wheel 16 which is arranged coaxially with the pulley 13 and is also rotatable around the pivot 14. A helical spring 18 is arranged between the pulley 13 and the gear wheel 16. The helical spring 18 is connected at one end to the pulley 13 and is wound around both a hub 19 of the pulley 13 and a hub 20 of the gear wheel 16. A peripheral toothing 21 of the gear wheel 16 engages a toothing 22 of a spindle 23 to which a centrifugal brake 24 is coupled. The centrifugal brake 24, also shown in FIG. 5, includes a pair of brake shoes 25 and is arranged inside a housing 26 that is substantially cylindrical in shape. The housing 26 is formed by assembling the mounting base 11 and flanges 27 and 28 which also serve as coverings of the device. Finally, on the mounting base 11 two pulleys 29 are also mounted which, besides changing a direction of force transmitted by the driving rope F, also tension the driving rope F and ensure that its contact angle on the pulley 13 is at least the minimum required for transmitting torque without the driving rope slipping.

The operation of the device 10 of the invention will now be discussed.

When, under the action of the torque transmitted by the driving rope F, the pulley 13 rotates in the direction of arrow R in FIG. 3 corresponding to the winding direction of the helical spring 18 of the free-wheel. The helical spring 18 is tightened on the hub 20 of the gear wheel 16 and engages the gear wheel 16 with the pulley 13. Rotation is thus imparted to the gear wheel 16 and therefrom to the spindle 23 to which the centrifugal brake 24 is coupled. Once the shoes 25 of the centrifugal brake 24 accelerate they are pulled outwardly by centrifugal force and their curved external surfaces come into frictional contact against an internal surface 32 of the cylindrical housing 26 in which the centrifugal brake 24 is arranged. A resisting torque is thus generated by friction which brakes the gear wheel 16 and the pulley 13 around which the driving rope F runs. When the pulley 13 is slowed down, the downward movement of the sliding door S is also slowed. The tension spring E which is loaded during the downward movement of the sliding door S also contributes to slowing down the sliding door S. When the user raises or opens the sliding door S, the tension spring E starts to release thereby reducing the force necessary for the wardrobe opening movement. Of course, when the pulley 13 reverses its rotation direction with respect to the previous direction indicated by the arrow R and rotates in the unwinding direction of the helical spring 18 of the free-wheel, the helical spring 18 slackens thereby disengaging the gear wheel 16 from the pulley 13.

From the foregoing, it can be clearly understood that the device of the present invention solves in a simple manner the problem of slowing the downward movement of the sliding door of a wardrobe. Furthermore, the device of the invention is relatively inexpensive and its overall dimensions are sufficiently small to permit it to be applied inside the wardrobe without taking up an unduly amount of space.

What is claimed is:

1. A device for use with a sliding door of a wardrobe, said device comprising:

a free wheel comprising a driving portion and a driven portion, said driven portion being coaxially aligned with said driving portion and having external toothing thereon;

a tension spring;

a driving rope engaged with said driving portion and having a first end to be fastened to the sliding door and another end to be fastened to a base of the wardrobe via said tension spring;

a spring arranged between said driving portion and said driven portion such that said driving portion is engaged with said driven portion when said first end of said driving rope is lowered during a downward movement of the sliding door and such that said driving portion is not engaged to said driven portion when said first end of said driving rope is raised during an upward movement of the sliding door;

a spindle having external toothing engaged with said external toothing of said driven portion; and a centrifugal brake coupled to said spindle such that a resisting torque is generated for braking said driving portion and said driven portion when said first end of said rope is lowered during the downward movement of the sliding door.

2. The device of claim 1, wherein:

said driving portion comprises a pulley having a grooved rim; and said driving rope is positioned in said grooved rim.

3. The device of claim 1, wherein:

said driven portion comprises a gear wheel.

4. The device of claim 1, wherein:

said spring is a helical spring having one end connected to said driving portion and is wound around said driving portion and said driven portion.

5. The device of claim 1, wherein:

said tension spring comprises one end connected to said driving rope and another end to be connected to the base of the wardrobe such that said tension spring is capable of tensioning said driving rope.

6. The device of claim 1, further comprising:

a pair of pulleys, engaged with said driving rope, for tensioning said driving rope and positioned such that a contact angle between said driving rope and said driving portion is suitable for transmitting torque without said driving rope slipping.

7. A wardrobe comprising:

a sliding door;

a base; and a device comprising a free wheel which includes a driving portion and a driven portion, said driven portion being coaxially aligned with said driving portion and having external toothing thereon, a tension spring, a driving rope engaged with said driving portion and having a first end fastened to said sliding door and another end fastened to said base via said tension spring, a spring arranged between said driving portion and said driven portion such that said driving portion is engaged with said driven portion during a downward movement of the sliding door and such that said driving portion is not engaged to said driven portion during an upward movement of the sliding door, a spindle having external toothing engaged with said external toothing of said driven portion, and a centrifugal brake coupled to said spindle such that a resisting torque is generated for braking said driving portion and said driven portion during the downward movement of said sliding door.

8. The device of claim 7, wherein:

said driving portion comprises a pulley having a grooved rim; and said driving rope is positioned in said grooved rim.

9. The device of claim 7, wherein:

said driven portion comprises a gear wheel.

10. The device of claim 7, wherein:

said spring is a helical spring having one end connected to said driving portion and is wound around said driving portion and said driven portion.

11. The device of claim 7, wherein:

said tension spring comprises one end connected to said driving rope and another end to be connected to said base such that said tension spring is capable of tensioning said driving rope.

12. The device of claim 7, further comprising:

a pair of pulleys, engaged with said driving rope, for tensioning said driving rope and positioned such that a contact angle between said driving rope and said driving portion is suitable for transmitting torque without said driving rope slipping.

* * * * *